US006565234B1

(12) United States Patent
Skegin et al.

(10) Patent No.: US 6,565,234 B1
(45) Date of Patent: May 20, 2003

(54) COUNTER LIGHT FIXTURE

(75) Inventors: Maer Skegin, West Hollywood, CA (US); Mark A. Pickett, Pasadena, CA (US); Scott Searle, Encino, CA (US)

(73) Assignee: Troy-CSL Lighting, Inc., City of Industry, CA (US)

( * ) Notice: Subject to any disclaimer, the term of this patent is extended or adjusted under 35 U.S.C. 154(b) by 0 days.

(21) Appl. No.: 09/340,071

(22) Filed: Sep. 20, 2000

(51) Int. Cl.[7] ..... F21V 29/00

(52) U.S. Cl. ..... 362/294; 362/133; 362/373; 362/427; 362/127

(58) Field of Search ..... 362/294, 373, 362/33, 133, 218, 427, 365, 147, 127

(56) References Cited

U.S. PATENT DOCUMENTS 4,941,071 A * 7/1990 Knauf ..... 362/133
5,351,172 A * 9/1994 Attree et al. ..... 362/373
5,909,955 A * 6/1999 Roorda ..... 362/133
6,050,708 A * 4/2000 Roorda ..... 362/133
6,428,188 B1 * 8/2002 Magno et al. ..... 362/253

* cited by examiner

*Primary Examiner*—Sandra O'Shea
*Assistant Examiner*—Guiyoung Lee
(74) *Attorney, Agent, or Firm*—Natan Epstein

(57) ABSTRACT

A halogen light fixture for mounting under a cabinet and over a counter surface, as in a kitchen, has a housing of continuous cross section between opposite end caps adaptable to fixtures of varying lengths, a rapidly accessible wiring compartment by tool free removal of a single partition, and an air flow path through the fixture housing including a heat shield arrangement for effective heat dissipation and cooler operation of the fixture.

33 Claims, 4 Drawing Sheets

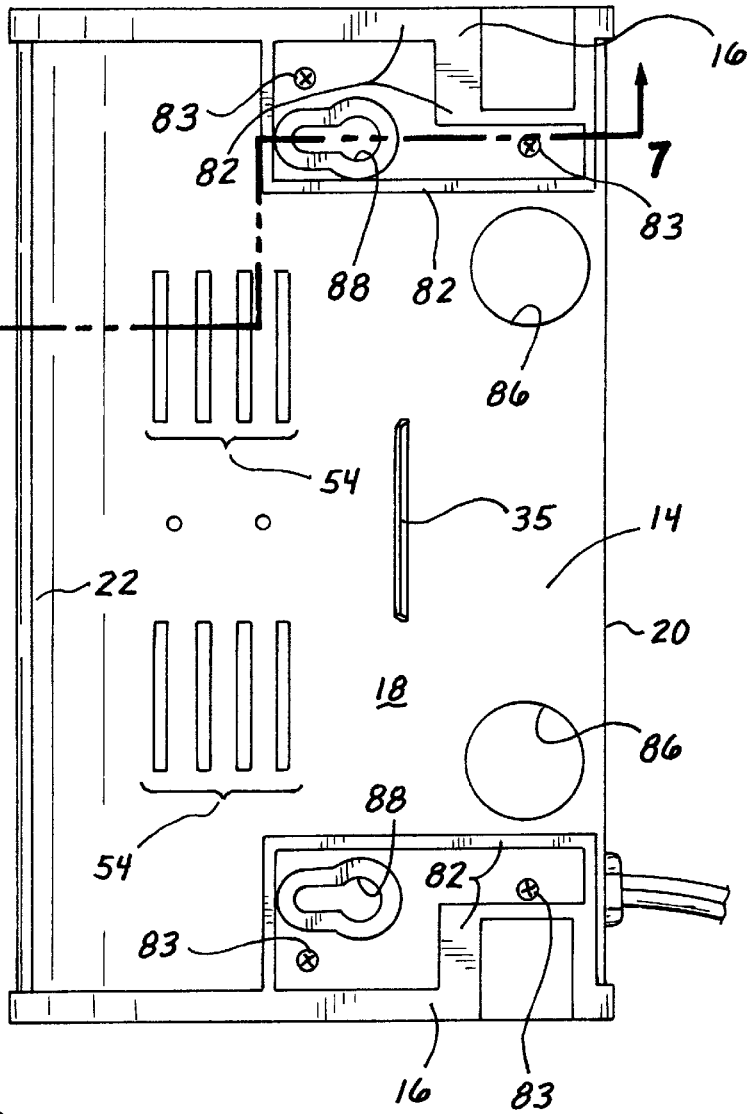
Fig. 6
Fig. 7
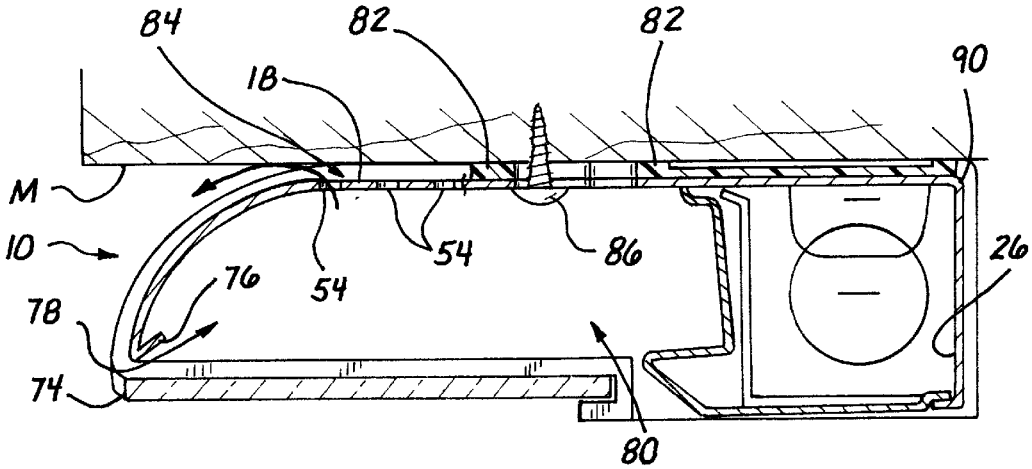

COUNTER LIGHT FIXTURE

BACKGROUND OF THE INVENTION

1. Field of the Invention

This invention pertains generally to the field of lighting fixtures and more particularly is directed to a fixture for mounting to the underside of a cabinet over a counter surface, such as in a kitchen, and featuring halogen lamps as the light source.

2. State of the Prior Art

Counter light fixtures constitute a substantial segment of the indoor lighting market and generally include lamp fixtures which can be mounted to the underside of wall-mounted cabinets, such as kitchen cabinets, for the purpose of illuminating a counter area under the cabinets. It is desirable that such counter lights have a slim profile for unobtrusive mounting under the cabinets. Many such fixtures are commercially available and typically rely on fluorescent lamp tubes as the light source. Counter lights are generally between one and two inches in height and of varying length depending on the length of the counter surface to be illuminated. The light fixture is commonly fastened by screws passing through mounting holes in the housing of the light fixture and driven into the wooden cabinet. Electrical power may be supplied to the fixture either by a power cord which is plugged into an A.C. wall outlet, or by an electrical conduit connected through a "knock-out" opening in the fixture housing.

A common problem in counter light fixtures is excessive heat buildup which is transferred to the cabinet above the fixture and eventually heats the cabinet interior. Temperature sensitive food stuffs or other materials stored in such a cabinet can be degraded or spoiled by the heat. The proximity of a hot lamp fixture to a counter surface is also undesirable for reasons of safety and comfort of those working there.

This problem is aggravated by halogen lamp bulbs which run hot compared to fluorescent tubes. The relatively small interior space of the lamp housing and its close proximity to the cabinet overhead prevents easy dissipation of rising hot air and conspires against easy ventilation of the lamp housing.

Existing counter lights also are unduly difficult and inconvenient to install because of the difficult access to the electrical wiring in the fixture. Often a wiring compartment is secured by multiple fasteners, such as sheet metal screws, which must be removed and replaced during installation. Replacement of such fasteners is difficult because it has to be made after the fixture is fastened to the underside of the cabinet, forcing the electrician to work in an awkward position.

What is needed is a halogen lamp counter light fixture with improved ventilation and heat dissipation characteristics and which is easier to install underneath hanging cabinets than currently available light fixtures.

SUMMARY OF THE INVENTION

This invention addresses the aforementioned needs by providing an improved counter light fixture having a housing which includes a housing cover extending between opposite end caps, and a removable interior partition also extending between the opposite end caps. The partition can be resiliently flexed by modest manual force into and out of retentive snap engagement with the housing cover thereby to define a substantially closed wiring compartment. A lamp socket and an electrical switch are on an outer side of the partition and are interconnected by electrical wiring on the inner side of the partition. The partition can be readily removed from and replaced on the cover without use of fasteners for more convenient access to the wiring during installation of said light fixture.

In a presently preferred fixture housing the cover also has a front and a rear extending downwardly from a generally planar center. The partition has a rear edge contained against the rear wall, and a front edge releaseably engageable to the planar center for retaining the partition to the cover under inherent spring force. The front edge of the partition may have a tab retained in a slot defined in the cover. The front edge is readily disengageable from the housing top by momentarily pressing against the spring force of the compressed partition to release the tab from the slot. The opposite end caps may be molded plastic fittings, and the front, center and rear of the housing top is preferably a single sheet of metal contained and supported between the plastic caps.

The light fixture has a reflector fixed to the underside of the housing top, and the partition is sized, shaped and configured to position a lamp inserted in the socket in predetermined relationship with the reflector. A heat shield plate is interposed between the reflector and the underside of the housing top. The reflector and the shield plate may be supported on a small number of small diameter metal rivets in spaced relationship from the underside to limit conduction of heat from the heat shield plate to the housing. For example, both the reflector and the plate may be mounted on one pair of such rivets. One or more vent openings are defined through the housing in overlying relationship with the heat shield plate such that hot air rising from a lamp in the socket is forced to flow around the plate and then into a cross flow space defined between the plate and the underside before exhausting through the vent openings.

A translucent light diffuser panel is supported to the housing under the reflector. The panel has a panel front edge and a panel rear edge. The panel front edge is spaced from the front of the housing top, and the panel rear edge is spaced from the interior partition thereby defining a front air gap and a rear air gap respectively to admit air flow upwardly into the housing for exhaust through the vent openings in the housing top thereby to cool the housing during operation of the light fixture. The diffuser panel is partially supported in front slots defined in the molded plastic end caps and secured against separation from the housing by a single screw passing through a screw hole in the panel and threaded into the housing top. The single screw may be threaded into a bracket permanently attached to the sheet metal housing top.

Mounting screw holes are provided through the cover and the end caps. The end caps have integral external spacer portions raised above the top surface of the cover, such that the sheet metal cover is spaced from an overlying mounting surface such as a wall cabinet when fastened thereto by screws passing through the screw holes. This spacing facilitates the exhaust of hot air through the vents. The molded plastic end caps preferably have knockouts removable for opening one or more holes and admitting electrical wiring into the wiring compartment to supply power to the light fixture.

As presently preferred, the housing of the counter light fixture has a first metal sheet bent in a transverse dimension to a predetermined cross section and a pair of molded plastic end caps grooved for receiving opposite side edges of the first metal sheet thereby to supports and retain the predetermined cross section of the metal sheet. A second metal sheet is bent along a transverse dimension parallel to the transverse dimension of the first metal sheet. The second metal sheet is installed as a partition in the housing to define therewith a wiring compartment between the end caps. The partition also serves as a mounting chassis for a lamp socket and an electrical switch mounted on the second metal sheet. Electrical wiring on an interior side of the second metal sheet interconnects the socket and the switch with power supply conduit or cord. The second metal sheet flexes under modest manual force into and out of retentive snap engagement with the first metal sheet such that the metal sheets can be readily separated without tools for access to the wiring. Neither the first nor the second metal sheets are bent along their longitudinal cross sections so that the cross section of the two metal sheets remains essentially the same along the length of the lamp fixture between the plastic end caps. As a result, the counter lamp fixture can be easily made in different lengths using the same end caps and with one or more lamp socket/reflector/heat shield assemblies spaced along the length of the fixture. For example, one lamp, two lamp and three lamp fixtures are contemplated of successively greater length but similar cross section.

These and other features, advantages and improvements of the present invention will be better understood from the following detailed description of the preferred embodiments taken in conjunction with the accompanying drawings.

BRIEF DESCRIPTION OF THE DRAWINGS

FIG. 6 is a top plan view of the light fixture of FIG. 1 depicting the vent openings for exhausting hot air and the plastic end caps of the fixture;

FIG. 7 is a sectional view taken along line 7—7 in FIG. 6;

DETAILED DESCRIPTION OF THE PREFERRED EMBODIMENTS

Figure 1:
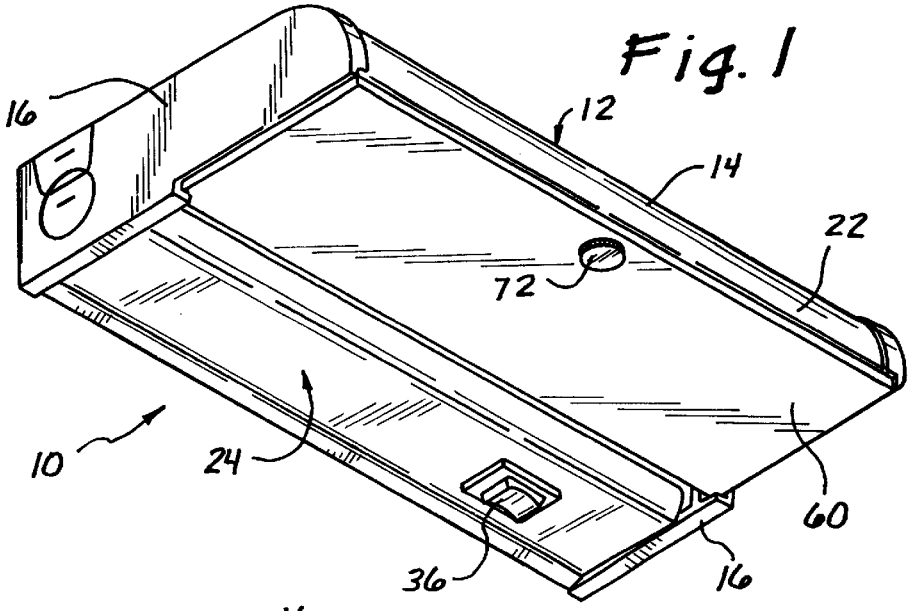
FIG. 1 is a perspective view of a single-lamp counter light fixture according to this invention.
Figure 2:
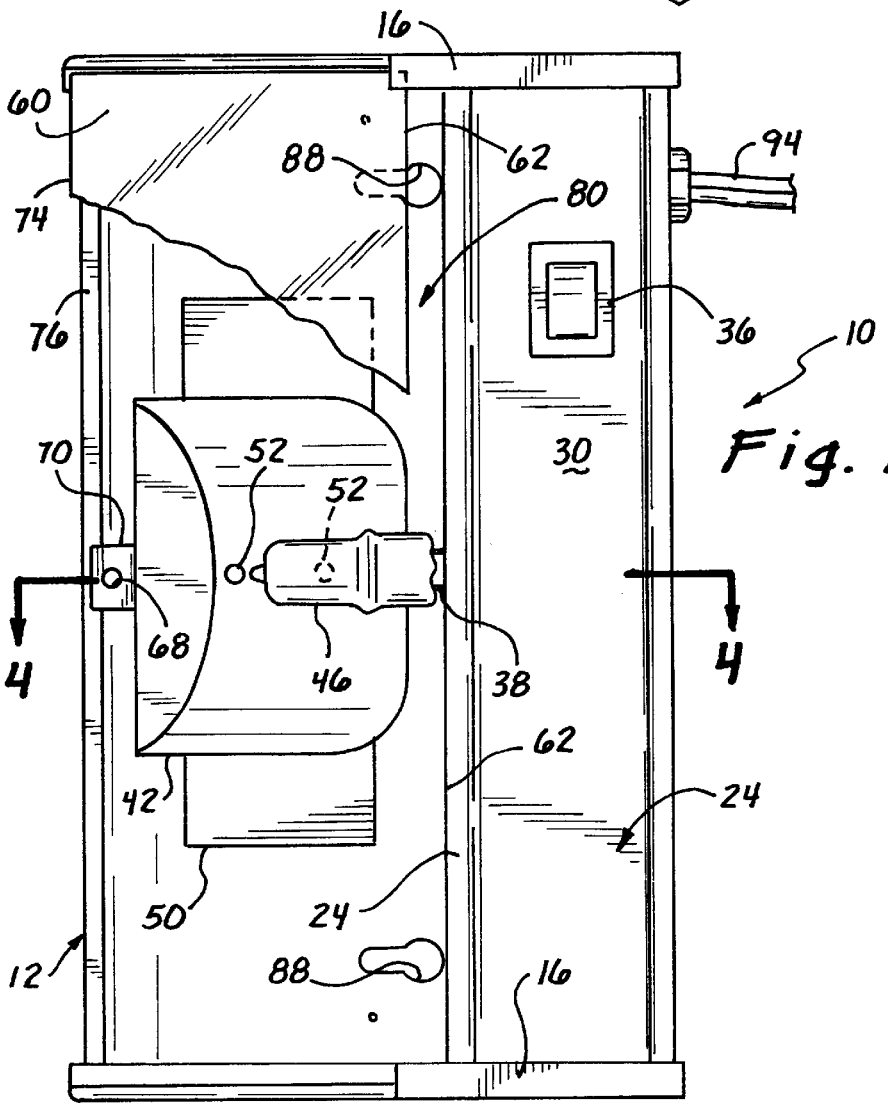
FIG. 2 is a bottom plan view of the light fixture of FIG. 1 with the diffuser panel partly broken away to show the lamp reflector and heat shield plate arrangement.

With reference to the accompanying drawings in which like elements are designated by like numerals, FIG. 1 shows a counter light fixture 10 intended for mounting to the underside of a wall cabinet. Typically the fixture illuminates a counter surface under the cabinet, a typical arrangement in home kitchens. The light fixture 10 is intended to operate with halogen lamps, which run hotter than other conventional light sources.

The lamp fixture has a fixture housing 12 which includes a cover 14 supported between two end caps 16. The cover 14 may be a single sheet of metal bent in a transverse dimension to define a generally planar housing top 18 between a rear wall 20 and a downwardly extending front 22. A removable interior partition 24 extends between the end caps 16 to define with the cover a wiring compartment 26 which runs the length of the housing 12. The partition includes a front 25 with a top edge 27 and a tab 28 projecting from the top edge, a bottom 30 with a rear edge 32, and side edges 34. The partition is assembled to the housing 12 by fitting the rear edge 32 against the rear wall 20 of the housing and pressing the front 25 towards the rear wall until it flexes sufficiently for tab 28 to align with and enter retaining slot 35, a condition depicted in FIG. 4. The inherent restorative spring force of the slightly deformed partition keeps the tab in the retaining slot and secures the partition to the fixture housing, providing a snap-in mounting of the partition 24. The partition is easily separated from the housing, without removing any screws or other fasteners and without use of any tools, simply by squeezing the front 25 slightly backwards along arrow P in FIG. 5 to pull tab 28 out of the slot 35 and free the partition from engagement with the housing. The partition can then be separated and removed from the housing 12 for access to the interior of compartment 26 in the manner illustrated by FIG. 3.

Figure 3:
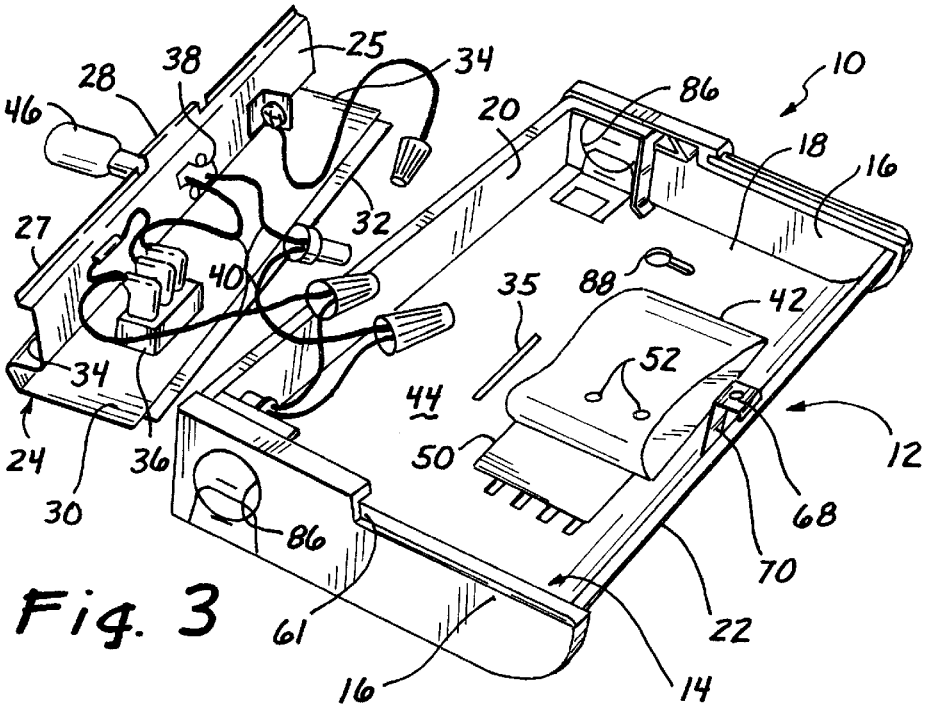
FIG. 3 shows the light fixture of FIG. 1 with the interior partition removed from the housing cover to show the electrical wiring of the fixture.

The partition provides a mounting chassis for the electrical components of the light fixture, namely power switch 36 mounted to the chassis bottom 30 and a lamp socket 38 mounted on the front 25 of the chassis. Switch 36 and socket 38 have terminal connectors interior to the compartment 26, and are interconnected by electric wiring 40 as seen in FIG. 3. The chassis or partition 24 can be completely removed from the housing 12 for easy access to all electrical connections during installation of the fixture 10.

Figure 4:
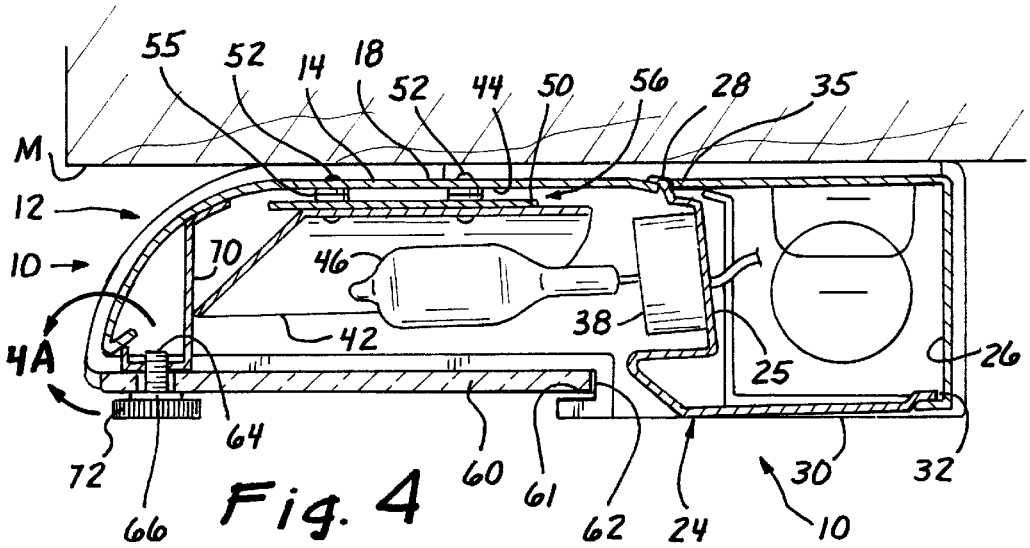
FIG. 4 is a cross sectional view of the light fixture taken along line 4—4 in FIG. 2.
Figure 5:
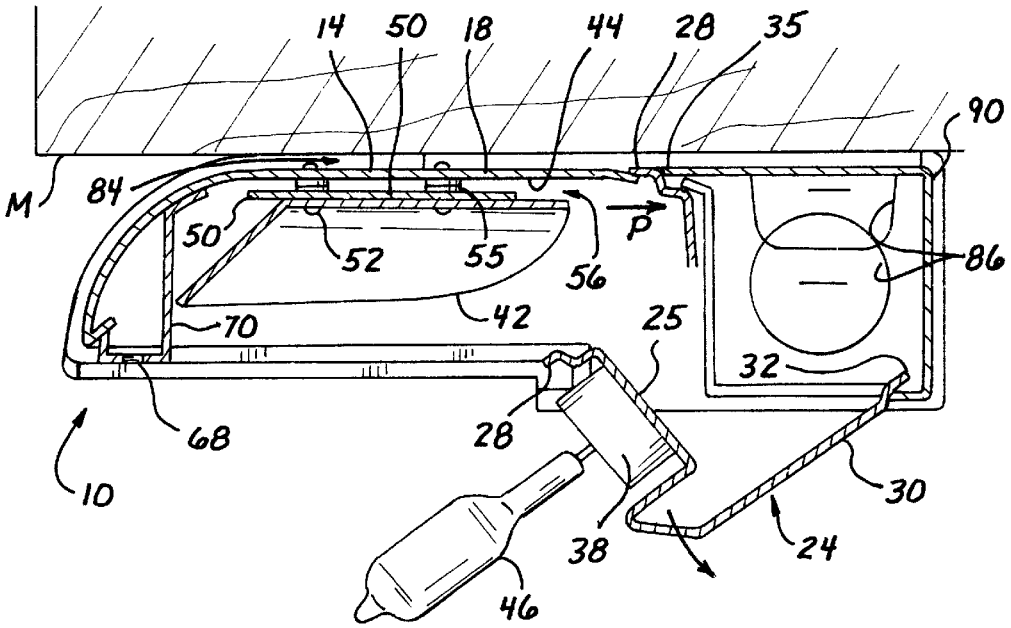
FIG. 5 is a cross sectional view as in FIG. 4 illustrating disengagement of the interior partition from the housing cover.

A light reflector 42 is mounted to an underside 44 of the cover 14 in overlying relationship to a lamp bulb 46 fitted into the lamp socket 38. A heat shield plate 50 preferably of sheet metal is interposed between the cover 14 and reflector 42 for shielding the cover from heat radiated by the reflector. The reflector 42 and the plate 50 are supported on a pair of relatively small metal rivets 52 fastened to the cover 14. The heat shield plate is supported on the rivets in spaced relationship to the underside 44 of the cover by spacer washers 55, as shown in FIGS. 4 and 5, so that heat flow to the cover is limited to conduction by the rivets. However, the rivets have a small cross section and offer a relatively low conductivity heat flow path from the reflector and shield plate to the cover. A number of vent slots 54 are cut through the cover. The vent slots are disposed over the heat shield plate 50 which to some extent also serves as a light shield to block light leakage through the vent slots. The spacing between the plate 50 and the underside 44 of the cover defines a relatively narrow cross-flow space 56 which admits air flow from the interior of the lamp housing for exhaust through the vent slots 54.

During operation of the light fixture the reflector 42 becomes quite hot due to its close proximity to the halogen lamp bulb 46. Dissipation of heat by conduction from the reflector is limited by the conductivity of the rivets 52. Heat is however transferred to air around the reflector which then tends to rise in the housing 12. The rising hot air encounters the undersurface of the shield plate 50, which blocks direct upward air flow to the vents 54, and is deflected laterally until it reaches the edges of the plate, at which point the hot air is again free to rise into the cross-flow space 56. Since the vents lie over the plate 50, the hot air is forced to flow laterally and generally horizontally into the cross-flow space and over the top surface of the plate in order to exhaust from the housing through the vents. This flow of air in close contact with both the undersurface and the top surface of the plate 50 tends to carry away heat from the plate and consequently reduces heat transfer from the plate to the housing cover 14. This effect is enhanced by the narrow spacing between the plate and the cover which causes air flow to speed up in the restricted passage of cross-flow space 56, thereby improving cooling of the shield plate 50, before finally exhausting through vents 54.

The light fixture also has a rectangularly shaped prismatic light diffuser panel 60 of glass or other transparent or translucent heat resistant material. As best seen in FIG. 4 the panel 60 is supported to the fixture housing partly by inserting the rear edge 62 into front slots 61 of the end caps 16, and secured to the housing 12 by a single screw 64 which passes through hole 66 in the panel and threads into screw hole 68 in a bracket 70 permanently fixed, as by welding, to the cover 14. The screw 64 has a knurled screw head 72 which can be turned without tools to facilitate initial assembly and installation of the fixture 10 and makes possible one-hand removal of the light diffuser panel 60 for cleaning.

Figure 4A:
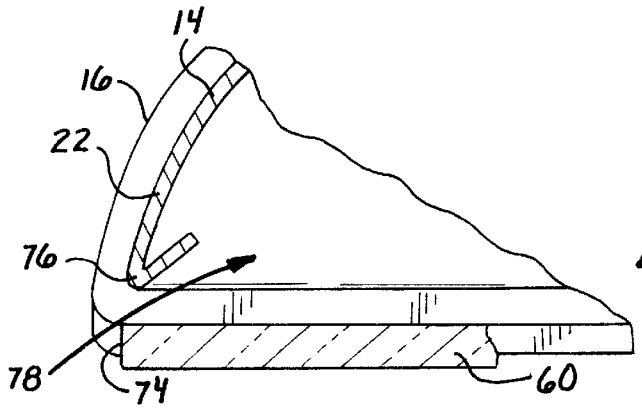
FIG. 4A is an enlarged view of detail area 4A in FIG. 4 showing the front air gap defined between the removable diffuser panel and the front of the housing cover for ventilation of the light fixture.

The front edge 74 of diffuser panel 60 is spaced from the lip 76 of the housing's downwardly sloping front 22, to define a first air gap 78, best seen in FIGS. 4A and 7. The rear edge 62 of panel 60 is similarly spaced from the front 25 of the partition 25 to define a second air gap 80. Both air gaps 78 and 80 extend the length of the housing between end caps 16 along the bottom of the fixture, and admit cool ambient air into the housing to replace hot air exhausting through top vent openings 54. As a result a steady flow of air passes through the fixture, cool air entering through the bottom and hot air exhausting through the top, during operation of the light fixture.

Flow of air through the light fixture housing 12 is further facilitated by exterior spacers 82 rising above the housing top 18, as best seen in FIG. 7. The spacers are preferably molded integrally with the plastic end caps 16. The housing 10 is fastened to or hung from a mounting surface M by means of two mounting screws 86 inserted in key slot holes 88 through top sheet 14 and each of the end caps 16, as seen in FIGS. 6 and 7. Spacers 82 hold the housing top away from the mounting surface M, e.g. the bottom of a wall hung cabinet, to provide a three-fold benefit. Firstly, the sheet metal housing top 18 is moved away from contact with the mounting surface M, thereby greatly reducing conductive heat transfer to the mounting surface. Secondly, an open exhaust space 84 is created between the fixture 10 and mounting surface M which provides an insulating layer of air and facilitates rapid diffusion of hot air exhausting through vent openings 54 into the environment. Thirdly, mounting surface M is insulated from the hot metal cover 14 by the plastic spacers 82.

Yet another feature of the light fixture 10 is that the cover has a constant profile along its length. That is, the cross-sectional shape of the cover is constant in the longitudinal dimension of the cover, from one end fitting 16 to the other, except for the various openings in the cover. Cover 14 is bent only across its width or transverse dimension, at a bend line 90 to define the rear wall 20 and a radius 92 to define the downward sloping front 22, as indicated in FIG. 5. The bend line and radius also extend the length of the cover from one end fitting 16 to the other. The side edges of cover 14 fit in supporting grooves or structures in end caps 16 which support the cross sectional shape of the cover 14. The end caps may be secured to the cover 14 by small screws 83 seen in FIG. 6.

Figure 8:
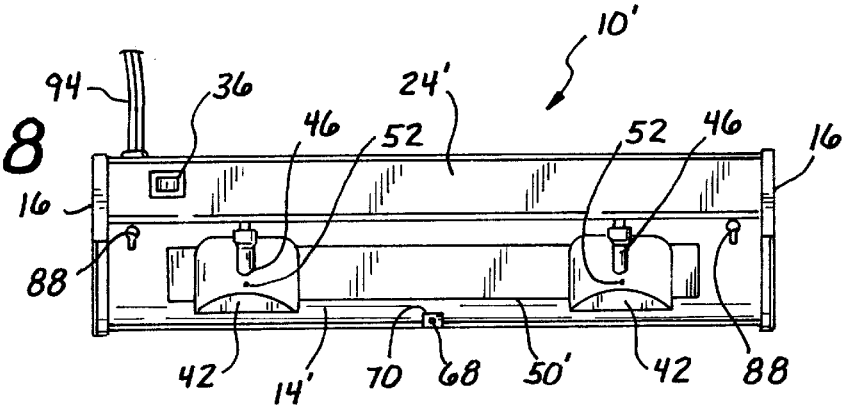
FIG. 8 is a bottom plan view of a two lamp version of the novel light fixture, shown without the diffuser panel to expose the two lamp reflectors and common heat shield plate.
Figure 9:
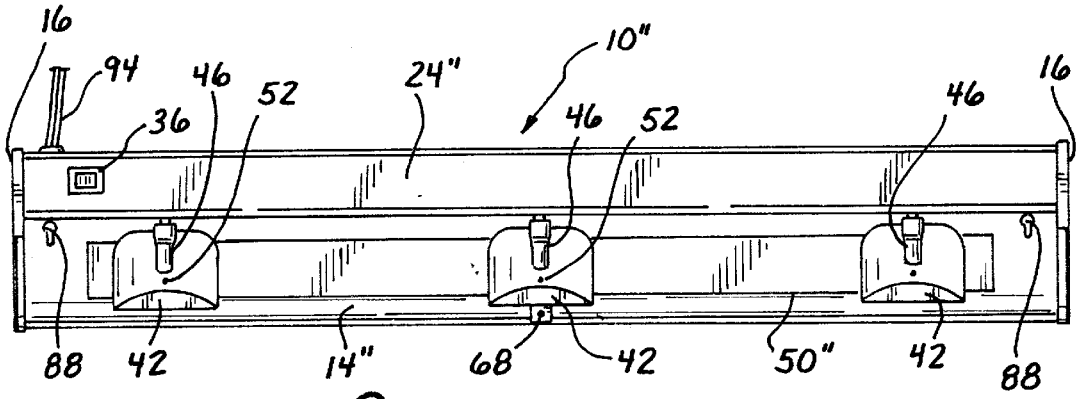
FIG. 9 is a bottom plan view of a three lamp version of the novel light fixture, shown without the diffuser panel to expose the three lamp reflectors and common heat shield plate.

The cross sectional shape of partition chassis 24 also remains the same along its length. As a result, both cover 14 and partition 24 can be easily made in arbitrary lengths to accommodate more than one lamp socket and reflector assembly. The same end caps 16 may be used regardless of the length of the cover and partition, thereby simplifying manufacture of different sized light fixtures. Also, the same lamp socket/reflector/shield plate arrangement can be repeated at spaced intervals along the housing length to make multi-lamp fixtures. For example, FIG. 8 shows a two lamp light fixture 10', while FIG. 9 depicts a three lamp light fixture 10". Each of the fixtures 10' and 10" retain all the improvements, advantages and features of the single lamp fixture 10 described in connection with FIGS. 1 through 7, and common elements in the fixtures 10, 10' and 10" are designated by like numerals which are primed to indicate a change in dimensions but not function. Instead of separate heat shield plates for the multiple sockets, a single heat shield plate 50' and 50" common to the several lamps is provided in light fixtures 10' and 10", respectively, to reduce parts count since the plates are rectangular sheets and simple to make in any length. However, the ventilation features remain substantially the same in the longer fixtures, with exhaust vent openings (hidden behind the plates 50', 50" in FIGS. 8 and 9) cut in the cover 14', 14" in overlying relationship to the heat shield plate. The extended fixtures 10' and 10" are shown without the diffuser panels to expose the interior. These fixtures are however provided with diffuser panels of length appropriate to the length of the fixture, and the diffuser panels define front and rear air gaps with the fixture housing as explained earlier in connection with FIGS. 4A and 7.

The end caps 16, which require no modification for fixtures of any length, may be of injection molded plastic and each equipped with integrally molded "knockout" 86 which can be opened to pass electrical supply wiring into the interior compartment 26 of housing 12. The knockouts in the end caps 16 can accommodate "wiremold" metal raceways, as well as Romex, flex conduit or rigid conduit. Additional knockouts may be provided in rear wall 20. Electrical power to the light fixture 10 can be delivered either by a conventional A.C. power cord 94 passed through a grommeted hole in rear wall 20, or for permanent installations suitable electrical conduit can be passed through any of the knockouts.

In the light fixtures shown in the drawings A.C. power is connected directly to each lamp socket. This arrangement requires use of high voltage halogen lamp bulbs designed to operate at A.C. line voltage. The light fixtures may be adapted, however, to use of low voltage bulbs by providing a suitable transformer or power converter in the wiring compartment 26.

From the foregoing it will be appreciated that a light fixture of simplified construction and assembly, easier maintenance and installation, improved ventilation and cooler operation has been disclosed.

While particular embodiments of the novel light fixture have been described and illustrated for purposes of clarity and example it should be understood that many changes, modifications and substitutions will be apparent to those having ordinary skill in the art without thereby departing from the scope of this invention, which is defined by the following claims.

What is claimed is:

1. A counter light fixture comprising:

a housing having a generally planar housing top, a rear wall depending from said top, a downwardly extending housing front terminating in a housing front edge, and opposite side walls, a removable interior partition including a partition front and a partition bottom extending between said opposite side walls, said partition being resiliently flexible by modest manual force into and out of retentive engagement with said housing thereby to define with said housing top and said rear wall a substantially closed compartment between said side walls, a lamp socket on said partition front and an electrical switch mounted on an outer side of said partition bottom and electrical wiring on an inner side of said partition interconnecting said socket and said switch, whereby said partition can be readily removed for access to said wiring during installation of said light fixture.

2. The counter light fixture of claim 1 wherein said partition has opposite side edges engageable to said opposite side walls of said housing, a rear edge arranged for engaging said rear wall, and a front engageable to said housing top for securing said partition to said housing.

3. The counter light fixture of claim 1 wherein said opposite side walls are molded plastic fittings, and said front, top and rear wall of said housing comprise a single sheet of metal contained between said opposite side walls.

4. The counter light fixture of claim 3 wherein said molded plastic fittings have knockouts removable for opening one or more holes for routing electrical supply wiring into said compartment.

5. The counter light fixture of claim 1 further comprising a reflector affixed to an underside of said housing top and overlying said socket and a heat shield plate interposed between said reflector and said underside for shielding said housing top from heat radiated by said reflector, said reflector and said plate being supported in spaced relationship away from said underside on fasteners offering a low conductivity heat flow path between said housing and said heat shield plate, thereby to reduce conduction of heat from said plate and said reflector to said housing, and one or more vent openings defined through said housing in overlying relationship with said plate such that hot air rising from a lamp in said socket flows around said plate and then between said plate and said underside to reach and pass through said vent openings whereby heating of said housing is reduced.

6. The counter light fixture of claim 5 further comprising a translucent panel supported to said housing under said reflector between said partition and said housing front edge, said translucent panel being spaced from said housing front edge and from said partition to define a front air gap and a rear air gap respectively to admit air flow upwardly into the housing for exhaust through said vent openings thereby to ventilate and cool said housing during operation of the light fixture.

7. The counter light fixture of claim 6 further comprising mounting screw holes in one of said housing top or said plastic fittings for fastening the housing to an overlying mounting surface and further including external spacer portions integral with said plastic fittings and raised above an exterior of said housing top such that said housing is spaced from a mounting surface when fastened thereto by screws in said screw holes thereby to facilitate air exhaust from said vent openings.

8. The counter light fixture of claim 6 wherein said translucent panel is partially supported in front slots defined in said molded plastic fittings and secured against separation from said housing by a single screw passing through a hole in said panel and engaged to said housing front.

9. The counter light fixture of claim 8 wherein said single screw is threaded into a bracket permanently attached to said metal sheet.

10. A light fixture comprising:

a housing having a housing top including an interior undersurface of said housing top;

one or more vent openings defined through said housing top;

a heat shield plate supported in closely spaced relationship to said housing top for covering said vent openings in the housing top, said heat shield plate being shaped to follow in substantially parallel relationship said interior undersurface thereby to define a cross flow space between the plate and the housing top;

said cross flow space as measured between said plate and said housing top being substantially narrower than a width or length of said plate over a substantial area of said plate underlying said vent openings such that heated air rising to said housing top from a lamp bulb mounted in said housing under said plate flows horizontally in said cross flow space prior to exhausting from said housing through said vent openings; and at least one lamp socket supported in said housing by means other than said heat shield plate.

11. The counter light fixture of claim 10 wherein said reflector and said plate are supported to said housing top by fasteners defining a heat flow path of relatively small cross section, whereby conductive heat transfer to said housing top is reduced.

12. The counter light fixture of claim 11 wherein said fasteners comprise two metal rivets each supporting both said reflector and said plate.

13. The counter light fixture of claim 10 further comprising a removable interior partition including a partition front and a partition bottom extending between opposite side walls of said housing defining with said housing top and a rear wall of said housing a substantially closed compartment between said side walls, at least one lamp socket on said partition front and an electrical switch mounted on an outer side of said partition bottom and electrical wiring on an inner side of said partition interconnecting said least one lamp socket and said switch; a translucent panel supported to said housing under said heat shield plate, said translucent panel being spaced from said housing front and from said partition to define a front air gap and a rear air gap respectively whereby air flow is admitted upwardly into the housing for exhaust through said vent openings thereby to cool said housing during operation of the light fixture.

14. The light fixture of claim 10 wherein all said vent openings in said housing are covered by at least one said heat shield plate.

15. The light fixture of claim 10 wherein said heat shield plate is sized so as to extend under unventilated portions of said housing top surrounding said vent openings.

16. The light fixture of claim 10 further comprising one or more light reflectors separate from said heat shield plate and affixed to an underside of said heat shield plate for directing light emitted by said lamp away from said housing top.

17. The light fixture of claim 10 further comprising a removable interior partition in said housing, said partition including a partition front and a partition bottom extending between opposite side walls of said housing for defining with a housing top and a rear wall of said housing a substantially closed compartment between said side walls, said least one lamp socket being mounted on said partition front.

18. The light fixture of claim 17 further comprising an electrical switch mounted on said partition bottom and electrical wiring on an inner side of said partition within said compartment for interconnecting said least one lamp socket and said switch.

19. The light fixture of claim 10 wherein said housing top and said heat shield plate are substantially planar.

20. The light fixture of claim 10 further comprising a light reflector between said heat shield plate and a lamp installed in said socket, a pair of rivets for supporting both said heat shield plate and said reflector to said housing top, and spacers on said rivets for spacing said heat shield plate from said housing top thereby to define said cross flow space.

21. A counter light fixture comprising:

a first metal sheet having a longitudinal dimension and a transverse dimension, said first metal sheet being bent along said transverse dimension to define a rear wall, a housing top and a housing front;

a pair of molded plastic end fittings grooved for receiving opposite transverse side edges of said first metal sheet;

a removable partition comprising a second metal sheet bent to define a partition front with a top edge and a partition bottom with a rear edge, said second metal sheet being assembled to said first metal sheet to define therewith a substantially closed wiring compartment between said plastic end fittings, said rear edge being supported against said rear wall of said first metal sheet and said top edge being secured to said housing top; and a lamp socket on said partition front and an electrical switch mounted on an outer side of said partition bottom and electrical wiring on an inner side of said partition interconnecting said socket and said switch, such that said wiring is normally contained in said wiring compartment and said partition can be removed for access to said wiring during installation of said light fixture.

22. The counter light fixture of claim 21 further comprising a translucent panel under said lamp socket partially supported in front slots defined in said molded plastic end fittings and secured by a single screw passing through a hole in said panel and threaded into a bracket attached to said first metal sheet.

23. The counter light fixture of claim 18 further comprising screw holes defined in said end fittings for admitting mounting screws for fastening said end fittings and said first metal sheet to a mounting surface, and wherein said end fittings have raised external spacer portions for spacing said first metal sheet away from the mounting surface thereby to facilitate air flow between the housing and said a mounting surface.

24. The counter light fixture of claim 22 further comprising a fastener for releaseably securing said top edge to said housing top, such that said fastener is readily accessible upon removal of said translucent panel for convenient disassembly of said partition and access into said wiring compartment.

25. The counter light fixture of claim 24 wherein said fastener comprises a tab projecting from said top edge and a retaining slot in said housing top, such that the partition can be flexed during assembly to align the tab for insertion into said retaining slot whereby the tab is retained in said slot under spring tension by the slightly deformed partition.

26. The counter light fixture of claim 24 wherein said partition is fastened by engagement of a single fastener with said housing top.

27. A light fixture comprising:

a housing having a housing top including an interior undersurface of said housing top, a housing front, a rear wall and opposite side walls;

a removable interior partition including a partition front and a partition bottom extending between said opposite side walls for defining with said housing top and said rear wall of said housing a substantially closed compartment between said side walls, at least one lamp socket on said partition front, an electrical switch mounted on said partition bottom and electrical wiring on an inner side of said partition within said compartment for interconnecting said least one lamp socket and said switch;

one or more vent openings defined through said housing top;

a heat shield plate supported in closely spaced generally parallel relationship to said housing top and for covering at least some of said vent openings in the housing top thereby to define a cross flow space between the plate and the housing top such that heated air rising to said housing top from a lamp bulb mounted in said lamp socket under said plate flows horizontally in said cross flow space prior to exhausting from said housing through said vent openings;

a translucent panel supported to said housing under said lamp, said translucent panel being spaced from said housing front and from said partition to define a front air gap and a rear air gap respectively, whereby air flow is admitted upwardly into the housing through each said gap for exhaust through said vent openings thereby to cool said housing during operation of the light fixture.

28. The light fixture of claim 27 wherein all said vent openings in said housing are covered by at least one said heat shield plate.

29. The light fixture of claim 28 wherein said heat shield plate is sized so as to extend under unventilated portions of said housing top surrounding said vent openings.

30. The counter light fixture of claim 27 wherein said partition is fastened by engagement of a single fastener with said housing top.

31. The counter light fixture of claim 27 further comprising a single fastener for releaseably securing said partition to said housing top, such that said single fastener is accessible upon removal of said translucent panel for disassembly of said partition and access into said wiring compartment.

32. The counter light fixture of claim 31 wherein said fastener comprises a tab projecting from said partition and a retaining slot in said housing top, said partition being dimensioned and constructed such that the partition can be flexed during assembly with said housing to align the tab for insertion into said retaining slot whereby the tab is retained in said slot under spring tension by the slightly deformed partition.

33. The counter light fixture of claim 27 further comprising one or more light reflectors separate from said heat shield plate and affixed to an underside of said heat shield plate for directing light emitted by said lamp away from said housing top.

* * * * *

UNITED STATES PATENT AND TRADEMARK OFFICE

CERTIFICATE OF CORRECTION

PATENT NO. : 6,565,234 B1
DATED : May 20, 2003
INVENTOR(S) : Maer Skegin, Mark A. Pickett and Scott Searle It is certified that error appears in the above-identified patent and that said Letters Patent is hereby corrected as shown below:

Title page,
Item [22], the filing date is -- June 25, 1999 --.

Signed and Sealed this

Second Day of December, 2003

JAMES E. ROGAN
*Director of the United States Patent and Trademark Office*